US007230579B2

(12) United States Patent
De Ruijter

(10) Patent No.: US 7,230,579 B2
(45) Date of Patent: Jun. 12, 2007

(54) DIRECTIONAL DUAL FREQUENCY ANTENNA ARRANGEMENT

(75) Inventor: Hendricus Clemens De Ruijter, Hilversum (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 5 days.

(21) Appl. No.: 10/523,619

(22) PCT Filed: Jul. 16, 2003

(86) PCT No.: PCT/IB03/03230

§ 371 (c)(1),
(2), (4) Date: Feb. 1, 2005

(87) PCT Pub. No.: WO2004/013935

PCT Pub. Date: Feb. 12, 2004

(65) Prior Publication Data

US 2005/0285810 A1 Dec. 29, 2005

(30) Foreign Application Priority Data

Aug. 1, 2002 (EP) ..... 02078154

(51) Int. Cl.
*H01Q 21/00* (2006.01)
*H01Q 19/00* (2006.01)

(52) U.S. Cl. ..... 343/844; 343/833; 343/702

(58) Field of Classification Search ..... 343/700 MS, 343/702, 844, 815, 833, 834
See application file for complete search history.

(56) References Cited

U.S. PATENT DOCUMENTS 5,121,504 A * 6/1992 Toko ..... 455/575.9
5,905,473 A * 5/1999 Taenzer ..... 343/834
6,034,638 A 3/2000 Thiel et al.
6,339,402 B1 * 1/2002 McKivergan ..... 343/702
6,515,635 B2 * 2/2003 Chiang et al. ..... 343/834
6,529,749 B1 * 3/2003 Hayes et al. ..... 455/575.7
6,757,267 B1 * 6/2004 Evans et al. ..... 370/334
6,844,854 B2 * 1/2005 Johnson et al. ..... 343/702
7,088,306 B2 * 8/2006 Chiang et al. ..... 343/817
2002/0089459 A1 * 7/2002 Johnson ..... 343/725

FOREIGN PATENT DOCUMENTS

AT 392 173 2/1991
EP 1 030 401 8/2000

* cited by examiner

*Primary Examiner*—Tan Ho
(74) *Attorney, Agent, or Firm*—Paul Im

(57) ABSTRACT

Consistent with an example embodiment, using two simple antennas with different frequencies of operation combined into an antenna arrangement a directional radiation pattern is obtained for both frequencies of operation. This is achieved by placing the antennas such that the first antenna acts as a director for the second antenna at the frequency of operation of the second antenna and the second antenna acts as a reflector for the first antenna at the frequency of operation of the first antenna. In another example embodiment, in the case of a monopole antenna the first antenna is shorter than the second antenna and can thus operate as a director while the second antenna is longer than the first antenna and can thus act as a reflector.

10 Claims, 5 Drawing Sheets

DIRECTIONAL DUAL FREQUENCY ANTENNA ARRANGEMENT

The present invention relates to an antenna arrangement comprising a first antenna element with a first operational frequency and a second antenna element with a second operational frequency.

When designing a recrivre or transmitter for dual frequency operation a common choice of antenna arrangements comprises a first mono pole antenna tuned for a first operating frequency and a second monopole antenna tuned for a second operating frequency and srlrcting the amtenna to be used depending on the chosen frequency of operation. When another frequency of operation is chosen the associated antenna os srlrcted and transmission and reception accomplished through this antenna.

The monopole antenna is often chosen because of it's low cost.

The problem associated with this type of antenna arrangement is that with current communication standards directivity as well as dual frequency operation is desired which would lead to a directional antenna comprising the radiating element as well as reflectors and/or directors for each operating frequency, thus leading to an antenna arrangement with many antenna elements.

It is the object of this invention to provide a multi-frequency directional antennas with less antenna elements.

This objective is achieved in that the antenna arrangement according to the invention is characterized in that the first antenna element is a director for the second antenna and that the second antenna is a reflector for the first antenna.

Antennas operated at higher frequencies are smaller than antennas operated at lower frequencies. The size of the second antenna is different from the size of the first antenna because of the different operational frequency. When the antenna arrangement is operated at the first operating frequency the first antenna acts as the radiating element of the antenna arrangement while the then passive second antenna, because of its different size than the first antenna, acts as either a director or a reflector for the first antenna. A directional antenna arrangement is achieved this way.

When the antenna arrangement is operated at the second operating frequency the second antenna acts as the radiating element of the antenna arrangement while the then passive first antenna, because of its different size than the first antenna, acts as either a director or a reflector for the second antenna. The size of the first antenna is different from the size of the second antenna because of the different operational frequency.

When the first operational frequency is higher than the second operational frequency the first antenna element functions as a director for the second antenna element, while the second element functions as a reflector for the first antenna element.

A further embodiment of the invention is characterized in that the first antenna element is a mono-pole antenna. The mono-pole is a very simple form of antenna that can function as the radiating element in an antenna and as a reflector or director and is thus especially suitable for use in the arrangement according to the present invention.

A further embodiment is characterized in that the second antenna element is a mono-pole antenna. The mono-pole is a very simple form of antenna that can function as the radiating element in an antenna and as a reflector or director and is thus especially suitable for use in the antenna arrangement according to the present invention.

A further embodiment is characterized in that the first antenna element is a quarter wavelength antenna element and the second antenna element is a quarter wavelength antenna element. The quarter wavelength mono-pole is an efficient radiator at an operational frequency where the length of the monopole is a quarter wavelength of the operational frequency. In the present invention multiple antenna elements are used. When using quarter wavelength antenna elements a compact antenna arrangement is achieved.

A further embodiment is characterized in that the distance between the first antenna element and the second antenna element is approximately one quarter wavelength of the highest of the first and second operational frequency.

It was found that by placing the two antenna elements at a distance of approximately one quarter wavelength of the highest of the first and second operational frequency optimal reflection and direction was obtained.

A Transceiver for dual frequency operation according to the invention comprising an antenna arrangement as claimed in claim 1, 2, 3 or 4 yields a transceiver with an directional antenna suitable for dual frequency operation.

A further embodiment of the transceiver is characterized in that the transceiver comprises a second antenna arrangement identical to the now first antenna arrangement. By including a second directional antenna arrangement the transceiver can better take advantage of the directionality of the antenna arrangement. Because of the low number of antenna elements needed to provide two directional antenna arrangements for dual frequency operation it is possible to equip the transceiver with two antenna arrangements.

A further embodiment of the transceiver is characterized in that the transceiver is arranged to use the first antenna arrangement and the second antenna arrangement for antenna diversity. When two antenna arrangements are available to the transceiver the transceiver can use antenna diversity to obtain better transmission and reception. Because the antenna arrangements are directed in different directions and have directional transmission and reception characteristics the transceiver can for instance implement antenna diversity by selecting the strongest signal coming from the two antenna arrangements thus improving the quality of reception and transmission.

A further embodiment of the transceiver is characterized in that the transceiver is arranged to use the first antenna arrangement and the second antenna arrangement for beam steering. Since two directional antenna arrangements can be used with the transceiver, because of the antenna arrangements compact size and directional characteristics, it is possible to employ beam-steering in order to improve the transmission and reception. Any method for beam-steering using two directional antenna arrangements can be used to obtain the beam-steering.

A further embodiment of the transceiver is characterized in that the first antenna arrangement and the second antenna arrangement are arranged such that the antenna elements are all comprised in a plane, that the antenna elements of each antenna arrangement are parallel to the other antenna elements in the antenna arrangement and that the first antenna arrangement is placed at an angle between 20 and 60 degrees to the second antenna arrangement.

By placing the antenna arrangements and the antenna elements in this position the theta components, i.e., horizontal polarization of the antenna, are directed in the horizontal plane.

To summarize: using two simple antennas with different frequencies of operation combined into an antenna arrangement, a directional radiation pattern is obtained for both frequencies of operation. This is achieved by placing the antennas such that the first antenna acts as a director for the second antenna at the frequency of operation of the second antenna and the second antenna acts as a reflector for the first antenna at the frequency of operation of the first antenna. In the case of a monopole antenna the the first antenna is shorter than the second antenna and can thus operate as a director while the second antenna is longer than the first antenna and can thus act as a reflector.

The invention will now be described based on figures.

FIG. 1*a* shows an antenna arrangement comprising two mono-pole antennas.

FIG. 1*b* shows an antenna arrangement comprising two mono-pole antennas.

Figure 1A:
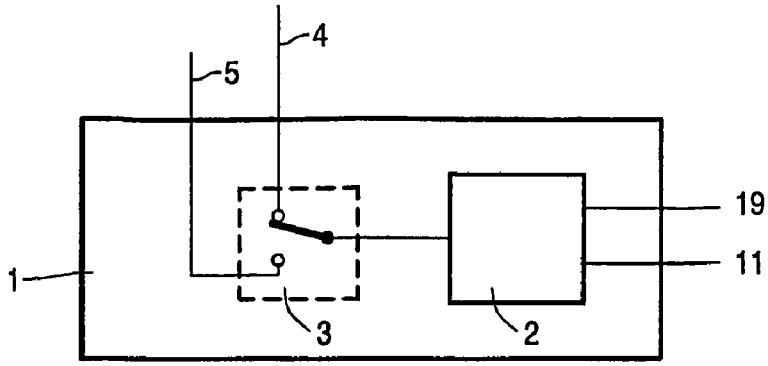
Figure 1B:
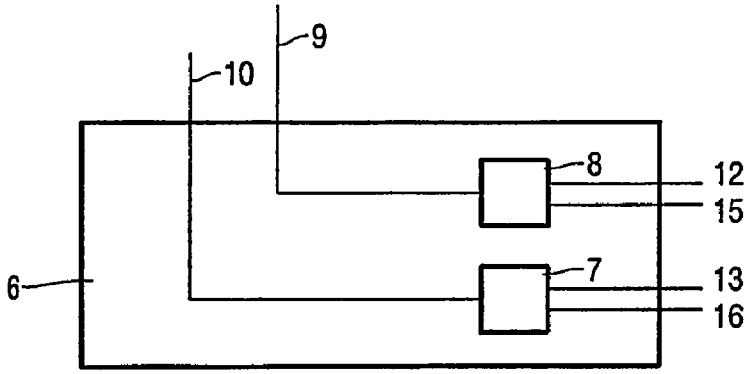
Figure 2:
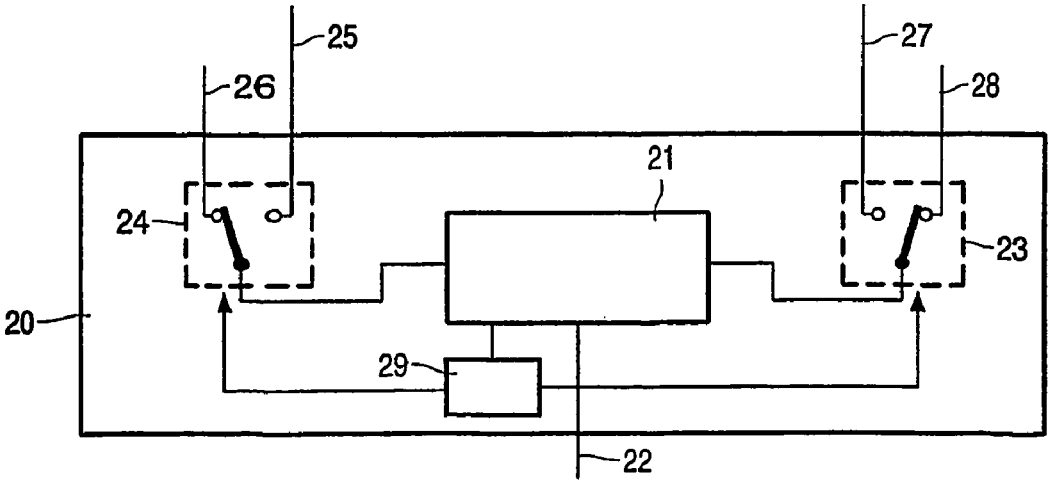
FIG. 2 shows a communication device comprising two antenna arrangements with two mono-pole antennas each.
Figure 3:
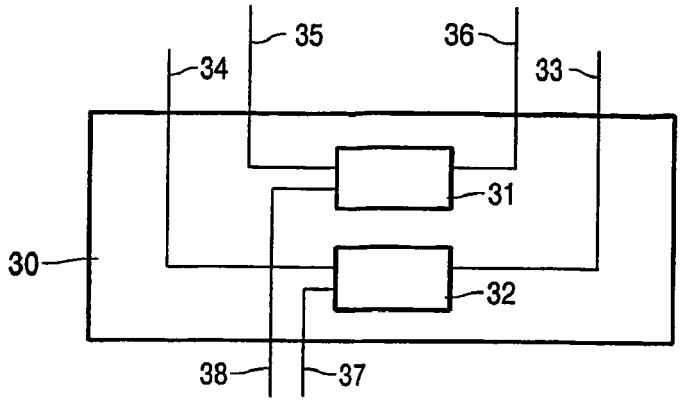
FIG. 3 shows the radiation pattern of the antenna arrangement when the first antenna element acts as the radiating element.
Figure 8:
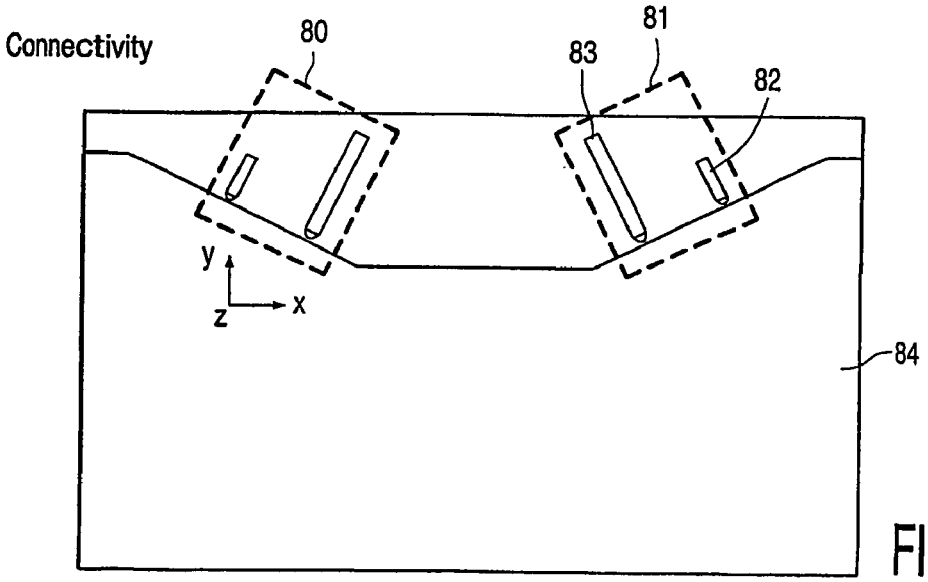

In the figures 1–3 the first antenna is drawn as a short monopole antenna while the second antenna is drawn as a longer monopole antenna. Even though the figures are intended as schematic diagrams that normally not confer information about physical proportions, the antennas are drawn similar to a normal configuration, i.e. one antenna shorter than the other antenna and placed at a distance of each other which is comparable to the length of the short antenna. In FIG. 8 a physical arrangement of the antenna arrangement is shown.

FIG. 1*a* shows communication station comprising an antenna arrangement comprising two mono-pole antennas. In order to accommodate dual frequency operation either a single dual frequency antenna or two separate single frequency antennas can be used. When using two antennas the simplest form is the mono-pole antenna. In FIG. 1*a* a communication station 1 with two monopole antennas 4,5 is shown where a single transceiver 2 is used to transmit and receive signals through the antennas 4, 5. When operation at a particular frequency is required a switch 3 connects the appropriate antenna 4, 5 to the transceiver 2. When one antenna is being used the other antenna is not being used. The transceiver 2 processes the signals. It transmits the data received at the input 11 and makes the received data available at the output 14.

FIG. 1*a* shows another implementation of a communication device comprising an antenna arrangement comprising two mono-pole antennas. Here the communication device 6 is required to operate at two frequencies simultaneously. Each antenna 9,10 is therefore dedicated to a separate transceiver 7, 8. In FIG. 1*b* antenna 9 is dedicated to transceiver 8 and antenna 10 is dedicated to transceiver 7. For this reason no switching is required. The transceivers 7,8 have an input 13, 12 and an output 16, 15.

FIG. 1*b* shows another implementation of a communication device comprising an antenna arrangement comprising two mono-pole antennas. Here the communication device 6 is required to operate at two frequencies simultaneously. Each antenna 9,10 is therefore dedictated to a separate transceiver 7,8. In FIG. 1*b* antenna 9 is dedicated to transceiver 8 and antenna 10 is dedicated to transceiver 7. For this reason no switching is required. The transceivers 7,8 have an input 13,12 and an output 16,15.

It is also important to note that when switching the antennas 4, 5 with the switch 3 the antenna not in use can be terminated with the appropriate impedance to ensure the antenna not in use acts as a director or reflector as required. The termination impedance can be connected to the antenna by a switch. By varying the terminations impedance the radiation characteristics of the active antenna can be altered.

In FIG. 1*b* where both antennas are operated simultaneously this is achieved differently. Both antennas operate at different frequencies. When the first antenna is operated at a first frequency, this first frequency is consequently not the operational frequency of the second antenna. It is therefore possible to ensure that while being driven by a transceiver matched to the antenna at its operational frequency the second antenna is terminated at a different impedance at the operational frequency of the first antenna. The same applies to the first antenna. The first antenna can be driven by the transceiver where the transceiver is matched to the antenna at the operational frequency of the first antenna while the termination impedance at the operational frequency of the second antenna can be chosen to ensure the first antenna acts as a reflector or a director at the operational frequency of the second antenna. In this way the communication device 6 can operate at both frequencies simultaneously and achieve directivity at each frequency with just two monopole antennas without additional antenna elements.

Several methods can be employed to feed the antennas, for instance microstrip or strip line techniques.

FIG. 2 shows a communication device comprising two antenna arrangements comprising two mono-pole antennas each. The communication device 20 comprises a transceiver 21 which uses antenna diversity to obtain the best reception quality. The switches 23,24 allow the transceiver to select two of a total of four antennas 25, 26, 27, 28. The first antenna 26 and the fourth antenna 28 have the same first operational frequency while the second antenna 25 and the third antenna 27 have the same second operational frequency. The first antenna 26 and second antenna 25 are physically grouped together, and the third antenna 27 and the fourth antenna 28 are physically grouped together. The first antenna 26 operates at a higher frequency as the second antenna 25 and forms, because of its shorter length than, and proximity to, the second antenna, a director for the second antenna 25. The second antenna 25 operates at a lower frequency tan the first antenna 26 and forms, because of its longer length and proximity to, the first antenna 26, a reflector for the first antenna 26. The same is true for the combination of the third antenna 27 and the fourth antenna 28 where the fourth antenna 28 acts as a director for the third antenna 27 and the third antenna 27 acts as a reflector for the fourth antenna 28.

The radiation pattern of each antenna 25, 26, 27, 28 is as a consequence directional. This directionality is a prerequisite for antenna diversity. If two antennas with identical reception of signals were to be used for diversity it would not be possible to employ antenna diversity. In the configuration shown in FIG. 2 the first antenna 26 and the second antenna 25 main lobe in the radiation pattern is towards the left, while the main lobe of the radiation pattern of the third antenna 27 and fourth antenna 28 is directed to the right. The transceiver 21 can thus select two antennas 25, 26, 27, 28 based on operational frequency using the switches 23, 24 and then can select the antenna with the better reception quality using well know techniques for antenna diversity.

In addition to antenna diversity, the configuration shown in FIG. 2 can also be used for beam steering applications since also for beam steering two directional antennas are advantageous. The phase differences required for beam steering can be achieved by the transceiver in the usual fashion.

FIG. 3 shows a communication device using antenna diversity while operating at two frequencies simultaneously. The communication device 30 comprises a first transceiver 31 and a second transceiver 32. The first transceiver is connected to the first antenna 34 and to the fourth antenna 33. The second transceiver is connected to the second antenna 35 and the third antenna 36. The first antenna 34 and the fourth antenna 33 operate at a first frequency which is higher than the operational frequency of the the second antenna 35 which is the same as the operational frequency of the third antenna 36.

As explained in figure 1*b* the first antenna 34 acts as a director for the second antenna 35 and the second antenna 35 acts as a reflector for the first antenna 34. The fourth antenna 33 acts as a director for the third antenna 36 and the third antenna 36 acts as a reflector for the fourth antenna 33. If the antennas are physically located as shown in FIG. 3 the main lobe of the radiation pattern of the first antenna 34 and the second antenna 35 is directed to the left and the main lobe of the radiation pattern of the third antenna 36 and the fourth antenna 33 is directed to the right. This provides the differences in signal reception as desirable for antenna diversity.

As explained in the description of FIG. 1*b* the first transceiver 31 is matched to the antennas 35, 36 it is connected to at the operational frequencies of the antennas 35, 36, but must provide an appropriate termination impedance at the operational frequency of the second transceiver 32 in order to turn the connected antennas 35, 36 into reflectors for the antennas 33,34 connected to the second transceiver 32.

Vice versa the second transceiver 32 is matched to the antennas 33, 34 it is connected to at the operational frequencies of the antennas 33, 34, but must provide an appropriate termination impedance at the operational frequency of the first transceiver 31 in er to turn the connected antennas 33, 34 into directors for the antennas 35, 36 connected to the first transceiver 31. This match outside the operational frequency of the transceiver 31, 32 can be achieved by modifying the impedance of the transceiver or by adding impedance elements connected to the antennas. The added impedance elements are then located outside the transceiver 31, 32.

In addition to antenna diversity, the configuration shown in FIG. 3 can also be used for beam steering applications since also for beam steering two directional antennas are advantageous. The phase differences required for beam steering can be achieved by each transceiver in the usual fashion.

Figure 4:
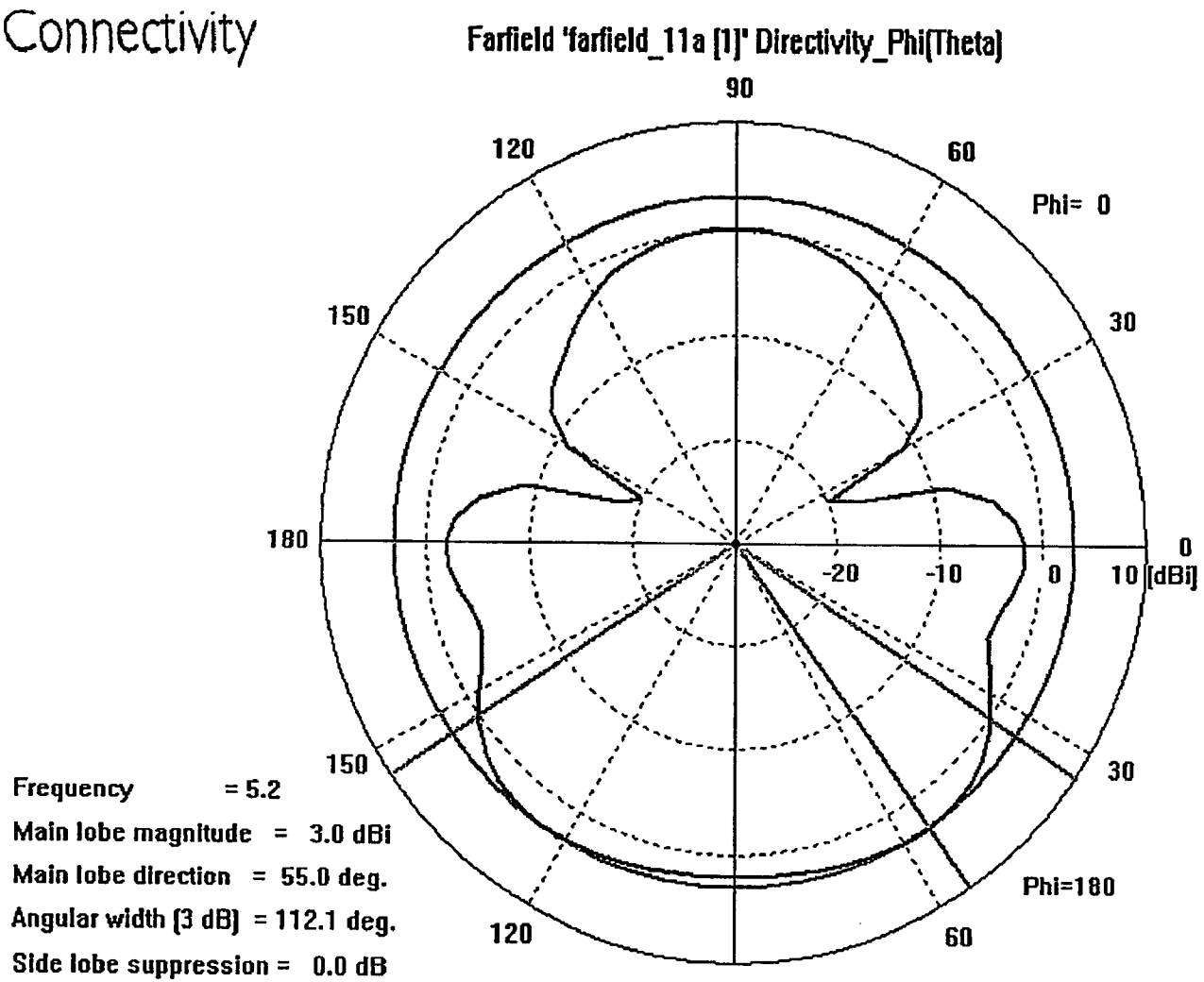
FIG. 4 shows the radiation pattern of the antenna arrangement when the second antenna element acts as the radiating element.

FIG. 4 shows the radiation pattern of the antenna operating at the first frequency in the antenna arrangement when the second antenna element acts as a reflector. As can be seen the reflector causes the omnidirectional radiation pattern of a regular monopole to be changed into a direction pattern with a main lobe 40.

Figure 5:
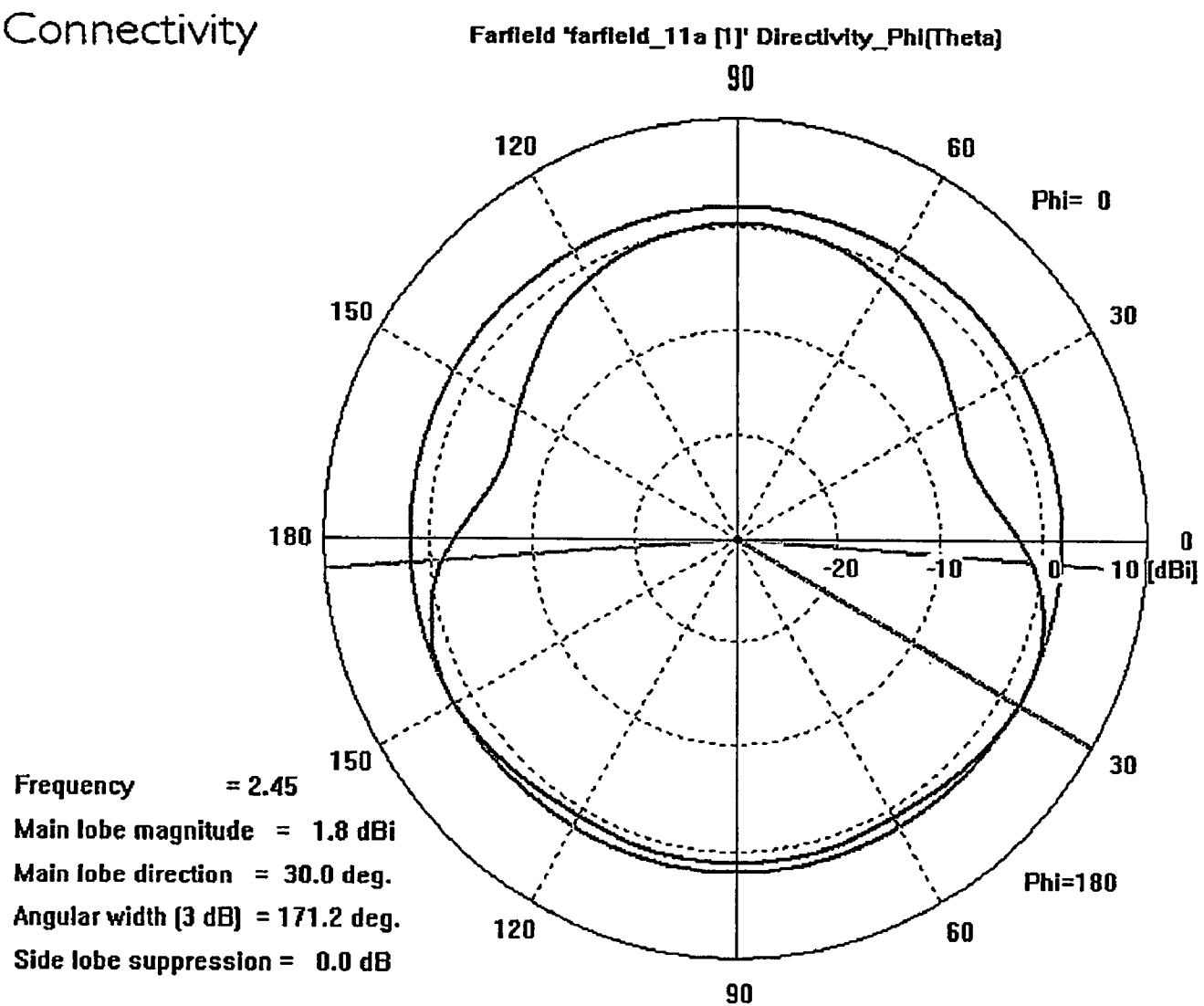
FIG. 5 shows two antenna arrangements and the resulting radiation pattern as can be used for antenna diversity and for beam steering.

FIG. 5 shows the radiation pattern of the antenna operating at the second frequency in the antenna arrangement when the first antenna element acts as a director.

As can be seen the director causes the omnidirectional radiation pattern of a regular monopole to be changed into a direction pattern with a main lobe 50.

Figure 6:
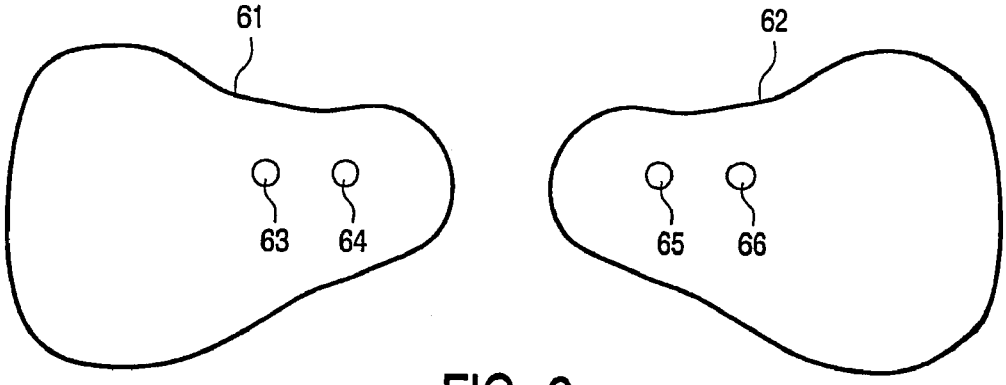
FIG. 6 shows the 3D radiation pattern of the antenna arrangement when the first antenna element acts as the radiating element.

FIG. 6 shows two antenna arrangements and the resulting radiation pattern as can be used for antenna diversity and for beam steering. By using two antenna arrangements each pointed in a different direction the antenna patterns provide for differences in the reception as required by antenna diversity. When a signal is poorly received by one antenna arrangement because the main lobe of the antenna pattern is directed away from the source, the main lobe of the other antenna arrangement is likely to be directed more advantageously.

Figure 7:
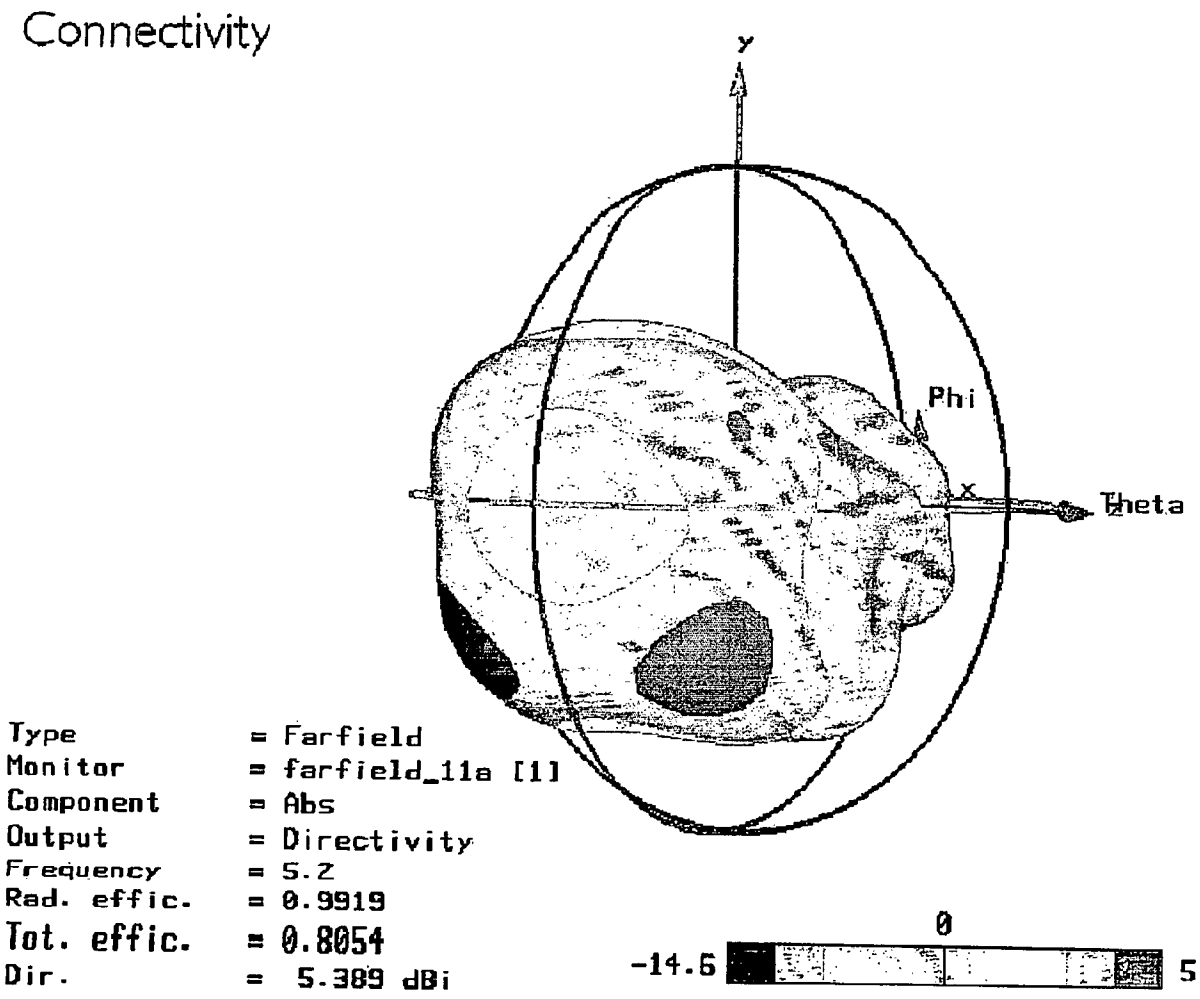
FIG. 7 shows a transceiver with two antenna arrangements located in a plane and at an angle to each other.

FIG. 7 shows the 3D radiation pattern of the antenna arrangement when the first antenna element acts as the radiating element. Due to the absence of grounding in front and behind the antenna arrangement a significant part of the radiated energy is directed downwards. FIG. 6 shows two main radiation directions. One main radiation direction is directed to the upper-left side having mainly Phi components (vertical polarization), the other to the lower left side having mainly Theta components (horizontal polarization).

FIG. 8 shows a transceiver with two antenna arrangements 80, 81 located in a plane and at an angle to each other. The horizontal polarization can be directed in the horizontal plane by tilting the antenna arrangements 80, 81 so that the main radiation direction of the horizontal polarization is lifted to the horizontal plane as is the case for the configuration as shown in FIG. 7. The vertical polarization can be positioned in the horizontal plane by tilting the antenna arrangements 80, 81 not towards each other as shown in FIG. 7 but away from each other, thus bending the beam downwards. As can be seen in FIG. 8 the ground plane 84 does not need to be perpendicular to the axis of the antenna 82, 83 but can be placed in the same plane as the axis of the antenna 82, 83.

The invention claimed is:

1. Antenna arrangement comprising a first antenna element with a first operational frequency and a second antenna element with a second operational frequency characterized in that the first antenna element is a director for the second antenna and that the second antenna is a reflector for the first antenna, wherein the first operational frequency is different from the second operational frequency.

2. Antenna arrangement as claimed in claim 1 characterized in that the first antenna element is a mono-pole antenna.

3. Antenna arrangement as claimed in claim 1 characterized in that the second antenna element is a mono-pole antenna.

4. Antenna arrangement as claimed in claim 1 characterized in that the first antenna element is a mono-pole antenna having a quarter wavelength antenna element and the second antenna element is a mono-pole antenna having a quarter wavelength antenna element.

5. Antenna arrangement as claimed in claim 4, characterized in that the distance between the first antenna element and the second antenna element is approximately one quarter wavelength of the first operational frequency.

6. Transceiver comprising an antenna arrangement as claim 1.

7. Transceiver as claimed in claim 6 wherein the antenna arrangement is a first antenna arrangement, and wherein the transceiver is characterized in that the transceiver comprises a second antenna arrangement identical to the first antenna arrangement.

8. Transceiver as claimed in claim 7 characterized in that the transceiver is arranged to use the first antenna arrangement and the second antenna arrangement for antenna diversity.

9. Transceiver as claimed in claim 7 characterized in that the transceiver is arranged to use the first antenna arrangement and the second antenna arrangement for beam steering.

10. Transceiver as claimed in claim 6 characterized in that the first antenna arrangement and the second antenna arrangement are arranged such that the antenna elements are all comprised in a plane, that the antenna elements of each antenna arrangement are parallel to the other antenna elements in the antenna arrangement and that the first antenna arrangement is placed at an angle between 20 and 60 degrees to the second antenna arrangement.

* * * * *